US008579281B1

(12) United States Patent
Thompson et al.

(10) Patent No.: US 8,579,281 B1
(45) Date of Patent: Nov. 12, 2013

(54) MULTIPLE NIP INVERTER

(71) Applicant: Xerox Corporation, Norwalk, CT (US)

(72) Inventors: Bruce Allen Thompson, Fairport, NY (US); Frank Albert Porter, Penfield, NY (US); Michael J. Linder, Walworth, NY (US); William Matthew Harney, Rush, NY (US); Robert Rinefierd, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/653,673

(22) Filed: Oct. 17, 2012

(51) Int. Cl.
*B65H 29/00* (2006.01)

(52) U.S. Cl.
USPC ..... 271/186

(58) Field of Classification Search
USPC ..... 271/186
See application file for complete search history.

(56) References Cited

U.S. PATENT DOCUMENTS

| | | | | | |
|---|---|---|---|---|---|
| 4,486,012 | A * | 12/1984 | Bock et al. | ..... | 271/3.15 |
| 5,771,058 | A * | 6/1998 | Kobayashi | ..... | 347/218 |
| 5,931,458 | A * | 8/1999 | Morimoto | ..... | 271/186 |
| 6,286,828 | B1 * | 9/2001 | Adema | ..... | 271/186 |
| 6,341,777 | B1 * | 1/2002 | Carter | ..... | 271/291 |

* cited by examiner

*Primary Examiner* — David H Bollinger
(74) *Attorney, Agent, or Firm* — Hoffmann & Baron, LLP

(57) ABSTRACT

A sheet inverter apparatus improves the handling capabilities of high speed printers and copiers. The sheet inverter apparatus includes a rotatable support having an axis of rotation and at least first and second arms radiating outwardly from the axis of rotation. First and second nip assemblies are is mounted to the first and second arms respectively. The support is rotatable to adjust positions of the first and second nips about the axis of rotation. Advantageously, with this arrangement, the support is adjustable so as to permit the first and second nips to receive sheets of paper at one location, be positionally adjusted with the sheets of paper moving therewith, and located at a second location so as to deliver the paper to an outlet feed path. This positional adjustment allows for inversion of the paper.

19 Claims, 5 Drawing Sheets

MULTIPLE NIP INVERTER

FIELD OF THE INVENTION

The present invention generally relates to document processing devices and methods for operating such devices. More particularly, the present invention relates to inverters for a document processing device.

BACKGROUND OF THE INVENTION

Inverters are known in the prior art for use with printmaking devices, particularly to invert a sheet of paper along a feed path. This allows for various operations, including front and back printing. Commonly, tri-roll inverters are used, such as that disclosed in U.S. Pat. No. 5,265,864 to Roux et al. With a tri-roll inverter, paper is introduced through a first nip of a tri-roll arrangement and fed into a reversing nip. The reversing nip accepts the sheet of paper moving in a first direction, causes the sheet of paper to stop and then drive the paper in a second direction, opposite that from the first direction. Upon being driven in the reverse direction, the sheet of paper is caused to pass through a second nip of the tri-roll arrangement. This allows for a sheet of paper to be flipped in orientation relative to the feed path.

With ever increasing volumes and velocities with printmaking devices, speed of handling paper at particular processes becomes a limiting factor. With a tri-roll arrangement, the need to accelerate the reversing nip in one direction, stopping and causing reverse movement provides a limiting factor as to the number of sheets per time intervals that can be handled through this arrangement. Although rapid servo motors and controls are available, the tri-roll inversion process can only be sped up to a certain level.

SUMMARY OF THE INVENTION

A sheet inverter apparatus is provided herein which includes a rotatable support having an axis of rotation and at least first and second arms radiating outwardly from the axis of rotation. An end of the first arm is attached to a first crank and an end of the second arm is attached to a second crank. The first arm and the second arm form a first coupling rod linking the first crank and the second crank in a drag link mechanism. A first nip assembly is mounted to the first crank. The first nip assembly includes a first nip drive roll and a first nip idler roll positioned so as to define a first nip therebetween. A second nip assembly is mounted to the second crank. The second nip assembly includes a second nip drive roll and a second nip idler roll positioned so as to define a second nip therebetween. The support is rotatable to adjust positions of the first and second nips about the axis of rotation. Advantageously, with this arrangement, the support is adjustable so as to permit the first and second nips to receive sheets of paper at one location, be positionally adjusted with the sheets of paper moving therewith, and located at a second location so as to deliver the paper to an outlet feed path. This positional adjustment allows for inversion of the paper.

In an embodiment, the sheet inverter apparatus includes a second coupling rod parallel to the first coupling rod, the second coupling rod being attached to the first crank and the second crank.

In an embodiment, the first and second cranks of the sheet inverter apparatus are vertically oriented in the document processing device, and the first coupling rod is attached to a top end of the first and second cranks, and the second coupling rod is attached to a bottom end of the first and second cranks.

In another embodiment, the present invention includes a document processing device. The document processing device includes a sheet inverter, which includes a rotatable support having an axis of rotation and at least first and second arms radiating outwardly from the axis of rotation, an end of the first arm being attached to a first crank and an end of the second arm being attached to a second crank. The first arm and the second arm form a first coupling rod linking the first crank and the second crank in a drag link mechanism.

A first nip assembly is mounted to the first crank, the first nip assembly includes a first nip drive roll and a first nip idler roll positioned so as to define a first nip therebetween. A second nip assembly is mounted to the second crank, the second nip assembly includes a second nip drive roll and a second nip idler roll positioned so as to define a second nip therebetween. The support is rotatable to adjust positions of the first and second nips about the axis of rotation. One of the nips is generally aligned with the paper feed path, and a sheet of paper is caused to enter the aligned nip and be engaged thereby such that the sheet of paper moves with the aligned nip, the sheet of paper moving with the aligned nip as the aligned nip rotates about the axis of rotation, the sheet of paper being caused to enter said paper outlet path with said aligned nip coming into general alignment with the paper outlet path.

The document processing device further includes a second nip assembly mounted to the second arm, the second nip assembly including a second nip drive roll and a second nip idler roll positioned so as to define a second nip therebetween. A paper feed path is positioned to direct paper therefrom, and a paper outlet path, spaced from the paper feed path, is positioned to receive paper from the inverter. The first and second nips can be rotated about the axis of rotation so as to be sequentially aligned with the paper feed path and the paper outlet path, and, wherein, with one of the nips being generally aligned with the paper feed path, a sheet of paper is caused to enter the aligned nip and be engaged thereby such that the sheet of paper moves with the aligned nip, the sheet of paper moving with the aligned nip as the aligned nip rotates about the axis of rotation, the sheet of paper being caused to enter the paper outlet path with the aligned nip coming into general alignment with the paper outlet path.

In another embodiment, the first arm of the sheet inverter apparatus radiates outwardly from the rotatable support diametrically opposed to the second arm so that the first and second arms are about 180° apart on a circumference formed by the arms. In another embodiment, the rotatable support of the sheet inverter apparatus is mounted on a movable frame.

In an embodiment, the sheet inverter apparatus further includes a third arm and a fourth arm, each radiating outwardly from the axis of rotation, an end of the third arm being attached to a third crank, and an end of the fourth arm being attached to a fourth crank. The third arm and the fourth arm form a third coupling rod linking the third crank and the fourth crank in a drag link mechanism. A third nip assembly is mounted to the third crank, the third nip assembly including a third nip drive roll and a third nip idler roll positioned so as to define a third nip therebetween. A fourth nip assembly is mounted to the fourth crank, the fourth nip assembly including a fourth nip drive roll and a fourth nip idler roll positioned so as to define a fourth nip therebetween.

The sheet inverter apparatus may further include a fourth coupling rod oriented parallel to the third coupling rod, the fourth coupling rod being attached to the third crank and the fourth crank. In another embodiment, the third and fourth cranks are vertically oriented in the document processing device, and the third coupling rod is attached to a top end of the third and fourth cranks, and the fourth coupling rod is attached to a bottom end of the third and fourth cranks.

In an embodiment, the third arm radiates outwardly from the rotatable support diametrically opposed to the fourth arm so that the third and fourth arms are about 180° apart on a circumference formed by the arms, wherein the first arm, third arm, second arm, and fourth arm are spaced at about 90° intervals respectively in a circumference formed by the arms.

In yet another embodiment, the sheet inverter apparatus of the present invention further includes a paper feed path leading into the sheet inverter, the paper feed path being defined by a nip drive roll and a nip idler roll. Further included is a paper outlet path defined by a nip drive roll and a nip idler roll, each of the paper feed path and paper outlet path being positioned adjacent one of the first, second, third, or fourth arms to define a pathway through with paper is fed and exited from the sheet inverter apparatus. Preferably, the first nip assembly is receptively positioned to receive paper from the paper feed path.

In an embodiment, the first nip assembly rotates away from the paper feed inlet after receiving a paper between the first nip drive roll and the first nip idler roll. The first nip assembly then rotates about 90° to a space previously occupied by the second nip assembly, wherein the first nip drive roll pauses in its rolling action in order to stably hold the paper between the first nip drive roll and the first nip idler roll during rotation of the nip assembly. Preferably, the first nip drive roll is controlled by a first drive motor, and the second nip drive roll is controlled by a second drive motor. In yet another embodiment, the rotatable support is controlled by an indexing motor for indexing said rotatable support, wherein the first drive motor and the second drive motor are independent of said indexing motor.

In an embodiment, the sheet inverter apparatus can invert at least about 225 pages per minute. In another embodiment, the sheet inverter apparatus can invert at least about 250 pages per minute.

These and other features of the invention will be better understood through a study of the following detailed description and accompanying drawings.

DETAILED DESCRIPTION

Figure 1:
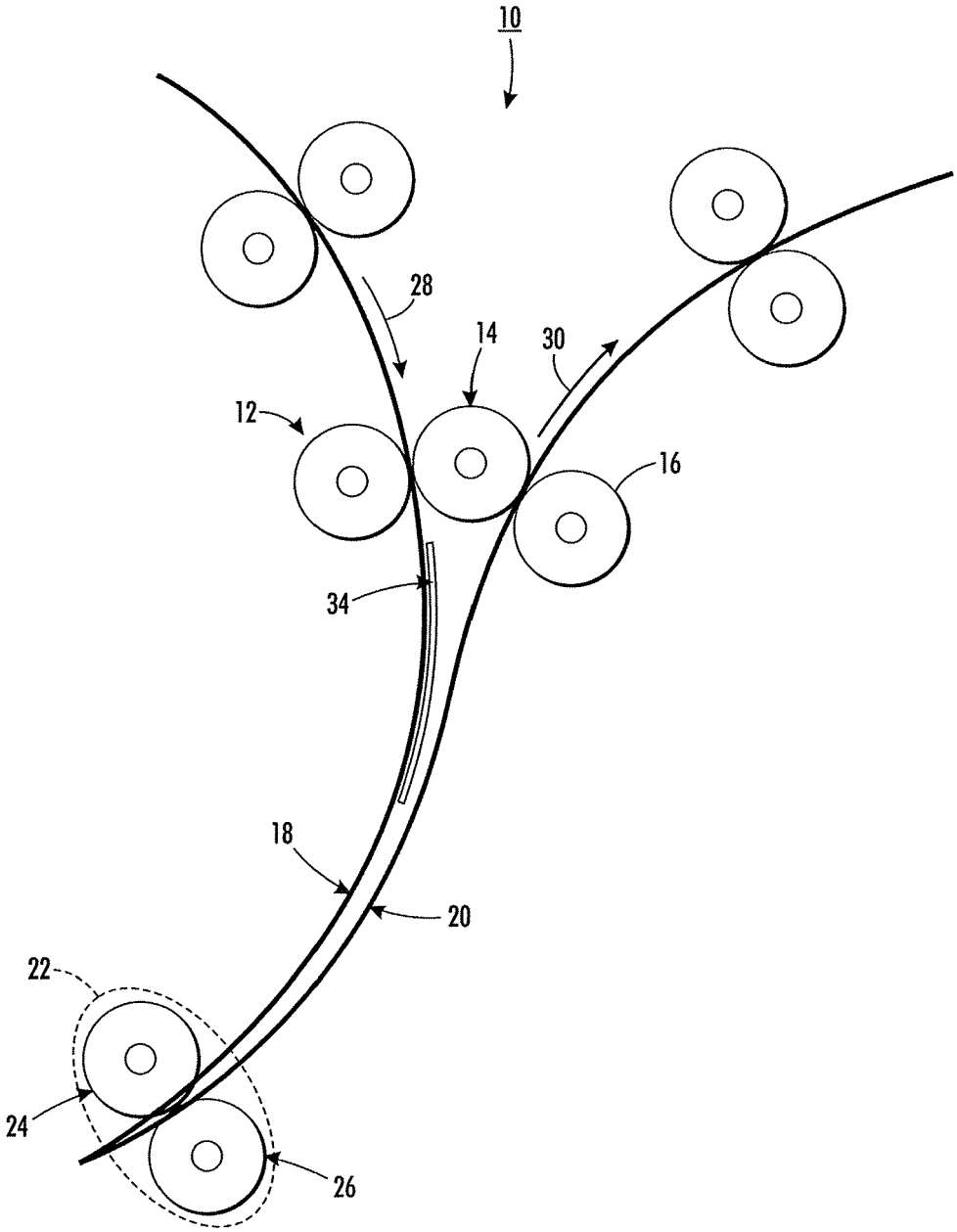
FIG. 1 is a schematic side view of a prior art tri-roll inverter.

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "substrate of media" refers to, for example, paper, transparencies, parchment, film, fabric, plastic, or other substrates on which information can be reproduced, for example, in the form of a sheet or web.

A "nip" refers to a location in a document processing device at which a sheet is propelled in a process direction. A nip may be formed between an idler wheel and a drive wheel.

A "nip assembly" refers to components, for example and without limitation, a nip drive roll and an nip idler roll which form a nip.

A "drive roll" refers to a nip assembly component that is designed to propel a sheet in contact with the nip. A drive roll may include a wheel, roller or other rotatable member. The drive roll may have an outer surface including a compliant material, such as rubber, neoprene or the like. The drive roll may be directly driven via a stepper motor, a DC motor or the like. Alternately, a drive roll may be driven using a gear train, belt transmission or the like.

An "idler roll" refers to a nip assembly component that is designed to provide a normal force against a sheet in order to enable the sheet to be propelled by the drive roll. An idler roll may include a wheel, roller or other rotatable member. The idler roll may have an outer surface including a non-compliant material, such as plastic.

A "drag link mechanism" refers to a four bar mechanism also known as a double crank mechanism useful for conveying motion between cranks which are linked together via a coupling rod.

Provided herein is an improved multiple nip inverter used to invert a substrate of media in a document processing device. Preferably, a sheet inverter is provided including a first nip assembly attached to a second nip assembly in rotatable fashion via a drag link coupling. The drag link preferably stays oriented vertical to the ground, and coupled with the rotation of the coupling rod it provides a natural motion for sheet inversion.

In a preferred embodiment, four nip assemblies are located at 90 degree intervals on a circumference, each supported by an arm rotating outwardly from a rotatable center of the sheet inverter apparatus. Advantageously, the inverter provides increased throughput for a document processing device without an increase in sheet velocity or acceleration. The inverter can work at the corresponding speed of the sheet through the rest of the document processing device, e.g., a linear speed of 1060 mm/sec and suitable account for typical accelerations within the document processing device; e.g., 2 g acceleration.

Because the nip assemblies are mounted on a movable assembly via a drag link mechanism, it provides for increased efficiency since the movement of the assembly can be used to correspond to the relative motion of the sheet in the machine space. Each nip assembly serves as a reversing roll inverter, but having multiple nip inverters enables parallel processing which improves throughput speed.

Additionally, the present invention is less expensive to produce than the prior art (e.g., reversing roll, or tri nip inverter) because of cost savings in the framework and baffles required to produce the design. The multiple nip inverter of the present disclosure further provides for a document processing device with a smaller machine footprint. Still further, the design of such document processing devices utilizing the multiple nip inverter allows for modularization of the design more so than the prior art.

Still further, because inversion of the sheet is being accomplished at lower velocity and accelerations as compared to the stationary reversing roll inverters, the substrates, or printing sheets suffer from less image abrasion on solid ink copies.

With reference now to the drawings, the known tri-roll inverter 10 of the prior art is shown. Such a tri-roll inverter is used, for example, in the Xerox iGen®, and includes an input nip formed by rollers 12 and 14 and an output nip formed between rollers 14 and 16, collectively a tri-nip roll. Input and output baffles 18 and 20 guide copy sheets into and out of the inverter. A corrugation system, or reversing system 22 includes a nip formed between rollers 24 and 26 which corrugates copy sheets entering the nip as they are driven by the input nip in the direction of arrow 28 and as the copy sheets are driven out of the inverter in the direction of arrow 30. Upon entry of the lead edge of a copy sheet 34, the copy sheet is propelled into the corrugator driver 26 of corrugation system. The copy sheet follows the baffle into the corrugator, where there is force applied throughout the remaining length of the copy sheet. This decreases the speed of the copy sheet. When the trail edge of the copy sheet clears the tri-roll input nip, the corrugator roller 26 slows the sheet to a stop, reverses the motor direction, accelerates the sheet back to the tri roll velocity, then delivers the sheet to the tri roll output path. It then slows down and stops after the tail end of the outgoing sheet has cleared the corrugating roll, reverses direction and accelerates up to the tri roll velocity to accept the next sheet. In order to achieve 250 papers per minute (ppm), the cycle time for this to happen is only 240 milliseconds. Each of these events happens serially and therefore the sheet velocities and accelerations required for this style of inverter are very high and would cause concern for sheet damage and jams. Solid ink images are particularly susceptible to corruption in this process.

The acceleration rates required by the reversing (or corrugating) roll can be estimated as a function of the tri roll velocity. At a tri roll velocity equal to the transfix roll velocity (1060 mm/sec), the reversing roll must accelerate/decelerate at a rate of 5.96 g's to maintain a 250 page per minute rate. If the tri roll velocity increases, this creates more of an inter document gap between the sheets and hence more time to accelerate and decelerate. Diminishing returns exist. Furthermore, going faster than approximately 1600 mm/second with an acceleration/deceleration rate of 3.1 g's is difficult to accomplish.

Figure 2:
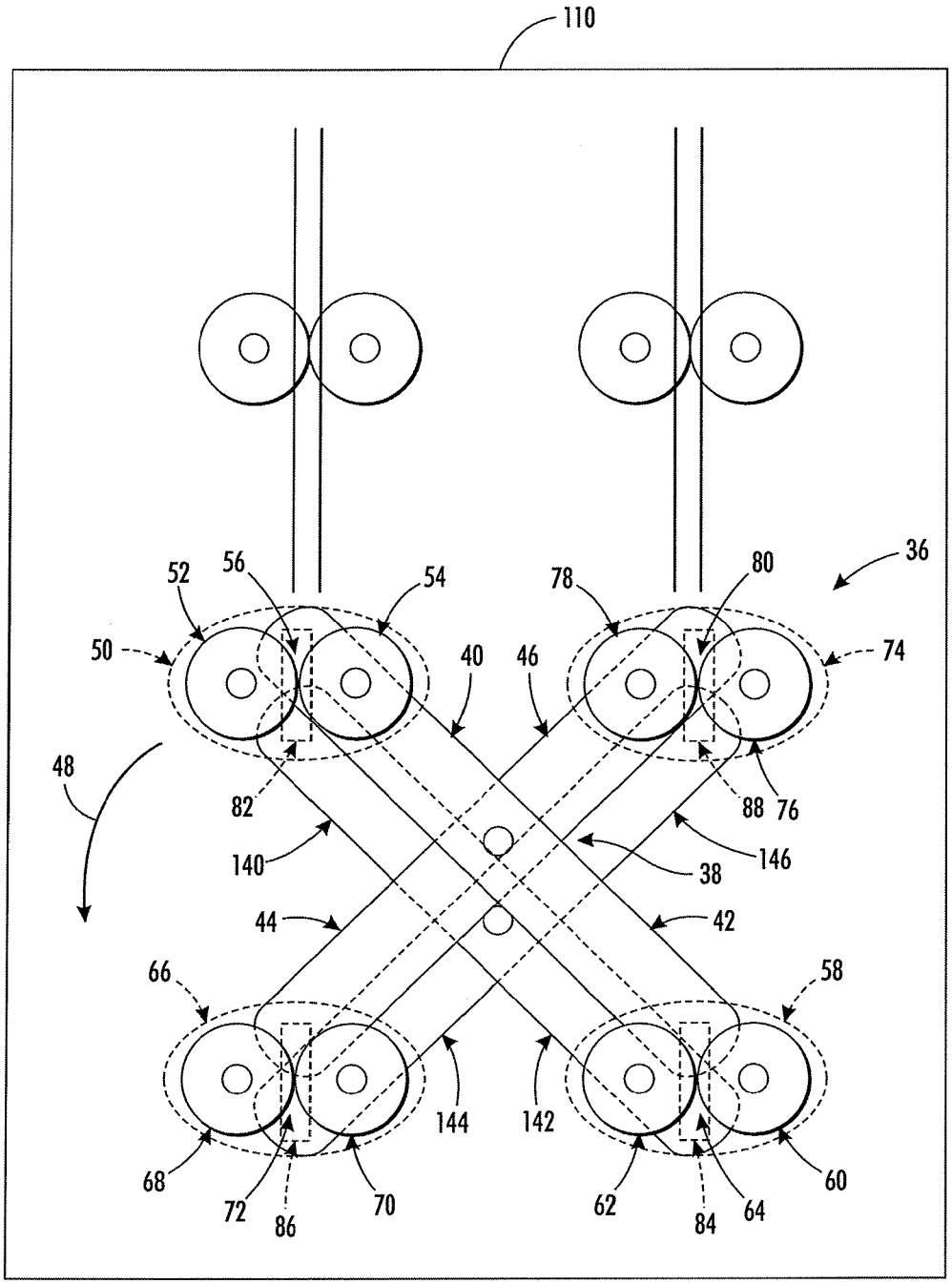
FIG. 2 is a schematic diagram of the multiple nip inverter of the present invention.
Figure 3:
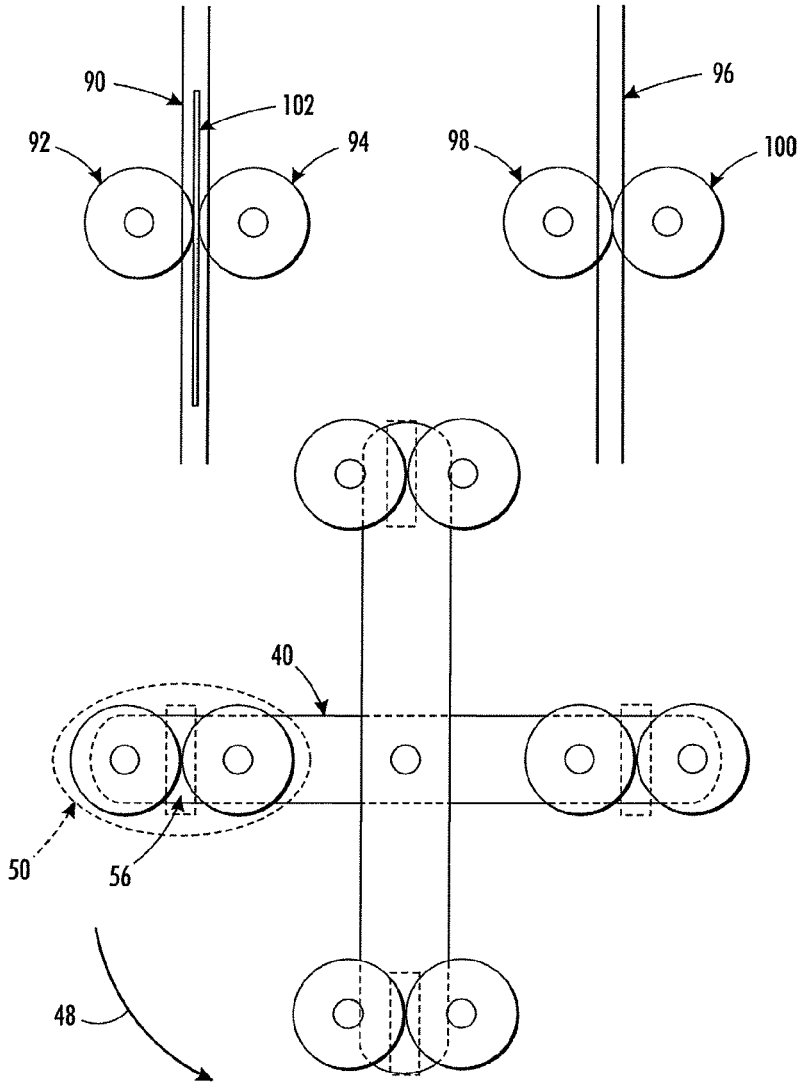
FIG. 3 is a schematic diagram showing a first rotational position of the multiple nip inverter of the present invention during its operation.
Figure 4:
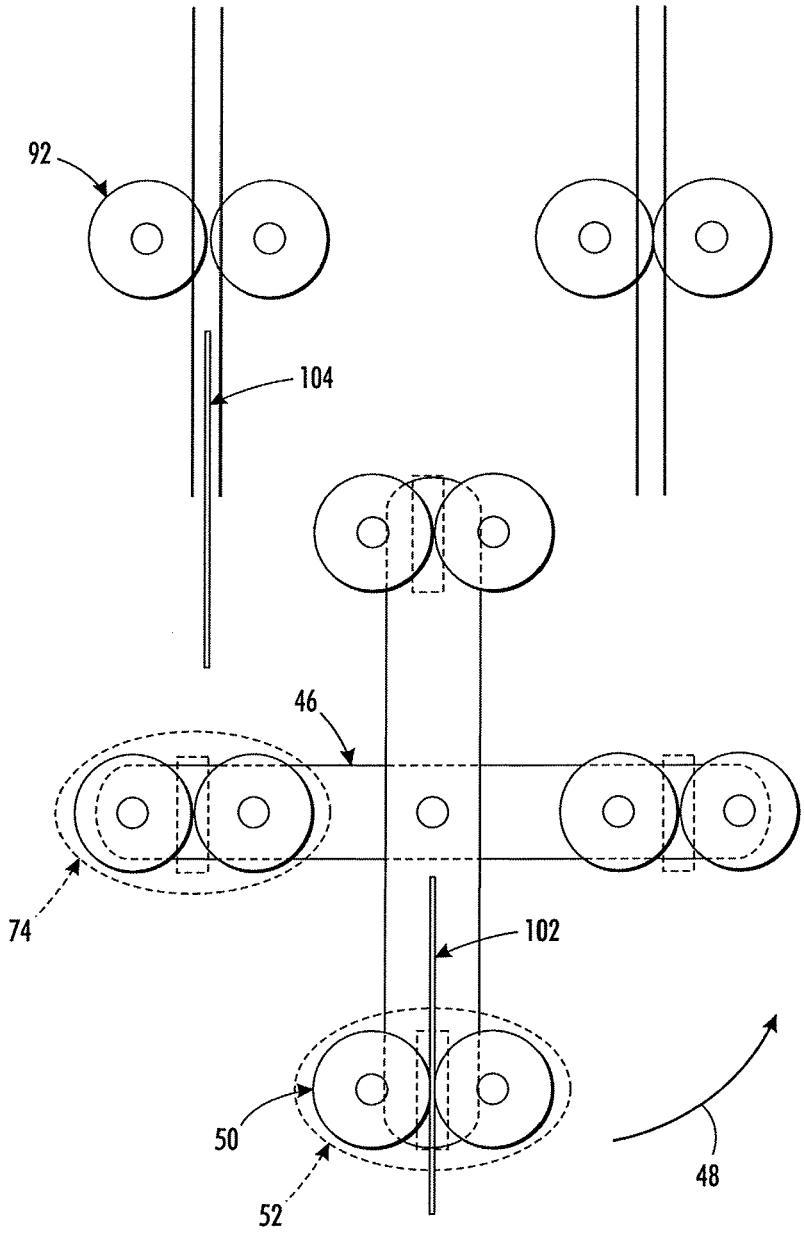
FIG. 4 is a schematic diagram showing a second rotational position of the multiple nip inverter of the present invention during its operation.

With reference now to FIGS. 2-4 of the drawings, a multiple nip inverter 36 of the present invention is shown. The multiple nip inverter is housed in document processing device 110. The inverter is used to invert a substrate of media in document processing device 10, typically a sheet of paper. The sheet inverter apparatus 36 includes a rotatable support 38. The rotatable support has an axis of rotation and at least first arm 40 and second arm 42 radiating outwardly therefrom. A third arm 44 and a fourth arm 46 also may radiate outwardly from the rotatable support 38. The support may rotate, for example in the counterclockwise direction 48 as shown in FIG. 2. Each of the first, second, third, and fourth arms support nip assemblies. A first nip assembly 50 is mounted to a first crank 82, which is in turn connected to first arm 40, the first nip assembly includes a first nip drive roll 52 and a first nip idler roll 54 positioned so as to define a first nip 56 therebetween. A second nip assembly 58 is mounted to a second crank 84, which in turn is mounted to second arm 42, the second nip assembly including a second nip drive roll 60 and a second nip idler roll 62 positioned so as to define a second nip 64 therebetween.

A third nip assembly 66 is mounted to a third crank 86, which in turn is mounted to third arm 44, the third nip assembly includes a third nip drive roll 68 and a third nip idler roll 70 positioned so as to define a third nip 72 therebetween. A fourth nip assembly 74 is mounted to a fourth crank 88, which in turn is mounted to fourth arm 46, the fourth nip assembly including a fourth nip drive roll 76 and a fourth nip idler roll 78 positioned so as to define a fourth nip 80 therebetween.

Each of the idler rolls may have an outer surface including a noncompliant material, such as hard plastic. Each of the drive rolls may include an outer surface having a compliant material such as rubber, neoprene or the like. The compliant material helps to grip the sheet and permit the drive roll to move the sheet through the nip. Each of the drive rolls rotates about a drive shaft and may be directly driven by a drive motor (not shown), such as a stepper motor, a DC motor or the like. A transmission device (also not shown) may extend between the drive motor and the drive roll for imparting motion to the drive roll. The transmission device may include a timing belt, gear trains or other transmission means known to those of ordinary skill in the art.

First arm 40 and second arm 42 radiate outwardly from a center point of the rotatable axis such that they are diametrically opposed and 180° apart on a circumference formed by the arms. First and second arms may be formed contiguously, and may be a first coupling rod, linking first crank 82 and second crank 84 in a drag link mechanism. The first coupling rod comprised of first arm 40 and second arm 42 is attached to first crank 82 and second crank 84 at the top of the vertically oriented cranks. A second coupling rod is substantially parallelly oriented to the first coupling rod. Second coupling rod is comprised of arms 140 and 142, and is attached to the bottom of vertically oriented first crank 82 and second crank 84. Drag link mechanisms are well known in the art, and provide further relative motion of the sheet inverter apparatus which enables it to better receive a sheet of paper. The cranks remain in a vertical orientation as can be seen in FIGS. 2-4.

Third arm 44 and fourth arm 46 radiate outwardly from a center point of the rotatable axis such that they are diametrically opposed and 180° apart on a circumference formed by the arms. Third and fourth arms may be formed contiguously, and may be a third coupling rod, linking third crank 86 and fourth crank 88 in a drag link mechanism. The third coupling rod comprised of third arm 44 and fourth arm 46 is attached to third crank 86 and fourth crank 88, respectively, at the top of the vertically oriented cranks. A fourth coupling rod is substantially parallelly oriented to the third coupling rod. Fourth coupling rod is comprised of arms 144 and 146, and is attached to the bottom of vertically oriented third crank 86 and fourth crank 88. The four arms together form a drag link of a cross mechanism.

A paper feed path 90 leads into said sheet inverter apparatus, the paper feed path including a nip drive roll 92 and a nip idler roll 94. A paper feed outlet path 96 is also provided, the paper feed outlet path including a nip drive roll 98 and nip idler roll 100.

Figure 5:
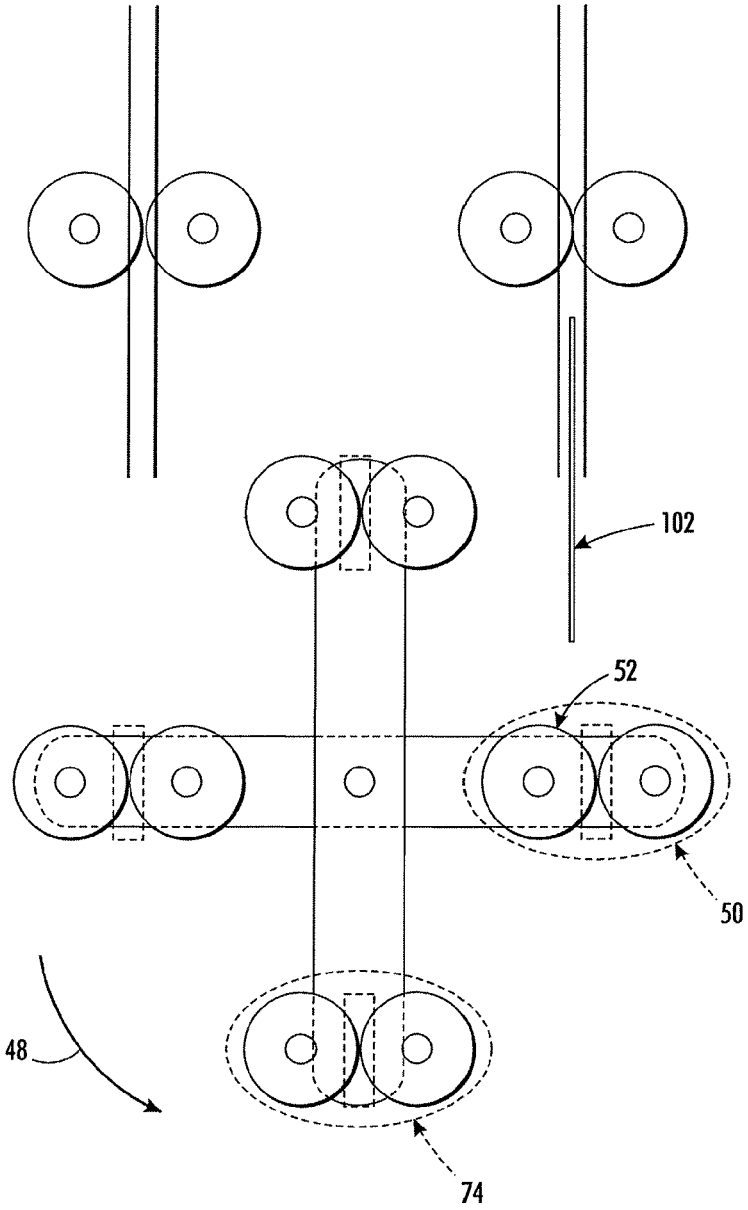
FIG. 5 is a schematic diagram showing a third rotational position of the multiple nip inverter of the present invention during its operation.

With reference now to FIGS. 3-5, a sheet of paper 102 enters sheet inverter apparatus 36 via paper feed path 90. The sheet is driven by nip drive roll 92. First arm 40 including first nip assembly 50 is positioned at the 9 o'clock position in order to receive sheet 102 in first nip 56. The sheet is motored through the paper feed path into first nip. As the trail end of sheet 102 passes an entrance sensor (not shown), first nip assembly slows down then stops sheet 102 relative to the nip drive. Rotatable support 38 then rotates 90° counter-clockwise in direction 48 so that first nip assembly 50 is then in the 6 o'clock position as shown in FIG. 4. Because the drive motor associated with first nip drive roll 52 has stopped, sheet 102 is held by nip 56 during the rotation.

Once the rotatable support has rotated 90°, fourth arm 46 is then positioned at 9 o'clock, the receiving position for a second sheet of paper 104. Fourth arm 46 including fourth nip assembly 74 is positioned at the 9 o'clock position in order to receive second sheet 104 in fourth nip 80. As the trail end of second sheet 104 passes the entrance sensor (not shown), fourth nip assembly then slows down then stops second sheet 104 relative to the nip drive. Rotatable support 38 then rotates again 90° counter-clockwise in direction 48 so that fourth nip assembly 74 is then in the 6 o'clock position, and first nip assembly 50 is positioned in the 3 o'clock position, as shown in FIG. 5.

After the second rotation, first nip drive roll 52 then powers up and drives first sheet 102 out of the inverter apparatus into paper outlet path 96. The process repeats continuously every 240 millisecond to invert multiple sheets on simultaneous tracks.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet inverter apparatus comprising:

a rotatable support having an axis of rotation and at least first and second arms radiating outwardly from said axis of rotation, an end of said first arm being attached to a first crank and an end of said second arm being attached to a second crank, and said first arm and said second arm forming a first coupling rod linking said first crank and said second crank in a drag link mechanism;

a first nip assembly mounted to said first crank said first nip assembly including a first nip drive roll and a first nip idler roll positioned so as to define a first nip therebetween;

a second nip assembly mounted to said second crank, said second nip assembly including a second nip drive roll and a second nip idler roll positioned so as to define a second nip therebetween, wherein, said support is rotatable to adjust positions of said first and second nips about said axis of rotation, wherein a paper feed path leading into said sheet inverter apparatus is defined by the first or the second nip assembly, and a paper outlet path leading away from said sheet inverter apparatus is defined by, selectively, the other of the first or the second nip assembly and, leading away from said sheet inverter apparatus, wherein paper is fed into the sheet driver apparatus through the paper feed path with an original orientation and exited from said sheet inverter apparatus in an orientation inverted to the original orientation.

2. The sheet inverter apparatus of claim 1 further comprising a second coupling rod parallel to said first coupling rod, said second coupling rod being attached to said first crank and said second crank.

3. The sheet inverter apparatus of claim 2 wherein said first and second cranks are vertically oriented, and said first coupling rod is attached to a top end of said first and second cranks, and said second coupling rod is attached to a bottom end of said first and second cranks.

4. The sheet inverter apparatus of claim 1 wherein said first arm radiates outwardly from said rotatable support diametrically opposed to said second arm so that said first and second arms are about 180° apart on a circumference formed by said arms.

5. The sheet inverter apparatus of claim 1 wherein said rotatable support is mounted on a movable frame.

6. The sheet inverter apparatus of claim 1 further comprising a third arm and a fourth arm, each radiating outwardly from said axis of rotation, an end of said third arm being attached to a third crank, and an end of said fourth arm being attached to a fourth crank.

7. The sheet inverter apparatus of claim 6 wherein said third arm and said fourth arm form a third coupling rod linking said third crank and said fourth crank in a drag link mechanism.

8. The sheet inverter apparatus of claim 7 wherein a third nip assembly is mounted to said third crank, said third nip assembly including a third nip drive roll and a third nip idler roll positioned so as to define a third nip therebetween; and a fourth nip assembly mounted to said fourth crank, said fourth nip assembly including a fourth nip drive roll and a fourth nip idler roll positioned so as to define a fourth nip therebetween.

9. The sheet inverter apparatus of claim 8 further comprising a fourth coupling rod parallel to said third coupling rod, said fourth coupling rod being attached to said third crank and said fourth crank.

10. The sheet inverter apparatus of claim 9 wherein said third and fourth cranks are vertically oriented, and said third coupling rod is attached to a top end of said third and fourth cranks, and said fourth coupling rod is attached to a bottom end of said third and fourth cranks.

11. The sheet inverter apparatus of claim 6 wherein said third arm radiates outwardly from said rotatable support diametrically opposed to said fourth arm so that said third and fourth arms are about 180° apart on a circumference formed by said arms, wherein said first arm, third arm, second arm, and fourth arm are spaced at about 90° intervals respectively in a circumference formed by said arms.

12. The sheet inverter apparatus of claim 1 wherein said first nip assembly is receptively positioned to receive paper from said paper feed path.

13. The sheet inverter apparatus of claim 12 wherein said first nip assembly rotates away from said paper feed inlet after receiving a paper between said first nip drive roll and said first nip idler roll.

14. The sheet inverter apparatus of claim 13 wherein said first nip assembly rotates about 90° to a space previously occupied by said second nip assembly, wherein said first nip drive roll pauses in order to hold said paper between said first nip drive roll and said first nip idler roll during rotation of said nip assembly.

15. The sheet inverter apparatus of claim 14 wherein said rotatable support is controlled by an indexing motor for indexing said rotatable support, wherein said first drive motor and said second drive motor are independent of said indexing motor.

16. The sheet inverter apparatus of claim 1 wherein said first nip drive roll is controlled by a first drive motor, and said second nip drive roll is controlled by a second drive motor.

17. The sheet inverter apparatus of claim 1 wherein at least about 225 pages per minute can be inverted.

18. The sheet inverter apparatus of claim 1 wherein at least about 250 pages per minute can be inverted.

19. A document processing device comprising:

a sheet inverter including:

a rotatable support having an axis of rotation and at least first and second arms radiating outwardly from said axis of rotation, an end of said first arm being attached to a first crank and an end of said second arm being attached to a second crank, and said first arm and said second arm forming a first coupling rod linking said first crank and said second crank in a drag link mechanism;

a first nip assembly mounted to said first crank said first nip assembly including a first nip drive roll and a first nip idler roll positioned so as to define a first nip therebetween;

a second nip assembly mounted to said second crank, said second nip assembly including a second nip drive roll and a second nip idler roll positioned so as to define a second nip therebetween, wherein, said support being rotatable to adjust positions of said first and second nips about said axis of rotation;

and wherein, with one of said nips being generally aligned with said paper feed path leading into said document processing device and the other nip is associated with a paper outlet path leading away from said document processing device, a sheet of paper is caused to enter said paper feed path with an original orientation and be engaged thereby such that the sheet of paper moves with said aligned nip, the sheet of paper moving with said aligned nip as said aligned nip rotates about said axis of rotation, the sheet of paper then being caused to exit said paper outlet path with an orientation inverted to the original orientation.

* * * * *